US007021972B2

(12) United States Patent
Richter et al.

(10) Patent No.: US 7,021,972 B2
(45) Date of Patent: Apr. 4, 2006

(54) MINIPLUG CONNECTOR ASSEMBLY

(75) Inventors: Michael Richter, Schalksmühle (DE); Joris Siliakus, Schalksmühle (DE); Fabrice Ruck, Rödental (DE); Heinz Lentowitsch, Gummbersbach (DE)

(73) Assignee: Lumberg Connect GmbH & Co. KG, Schalksmuhle (DE)

( * ) Notice: Subject to any disclaimer, the term of this patent is extended or adjusted under 35 U.S.C. 154(b) by 0 days.

(21) Appl. No.: 11/001,696

(22) Filed: Dec. 1, 2004

(65) Prior Publication Data

US 2005/0142947 A1 Jun. 30, 2005

(30) Foreign Application Priority Data

Dec. 11, 2003 (DE) ..... 103 58 271
Nov. 25, 2004 (DE) ..... 10 2004 057 052

(51) Int. Cl.
*H01R 13/24* (2006.01)

(52) U.S. Cl. ..... 439/700; 439/289

(58) Field of Classification Search ..... 439/700, 439/289, 78, 81, 86, 66
See application file for complete search history.

(56) References Cited

U.S. PATENT DOCUMENTS 5,158,468 A * 10/1992 Curtis et al. ..... 439/76.1
5,259,769 A * 11/1993 Cruise et al. ..... 439/65
5,540,599 A * 7/1996 Bishop ..... 439/289
5,584,713 A * 12/1996 Kato et al. ..... 439/188
5,716,230 A * 2/1998 Marren et al. ..... 439/500
5,967,856 A * 10/1999 Meller ..... 439/700
5,993,231 A * 11/1999 Hoolhorst ..... 439/218
6,083,059 A * 7/2000 Kuan ..... 439/862
6,241,537 B1 * 6/2001 Tate et al. ..... 439/108

* cited by examiner

*Primary Examiner*—Alexander Gilman
(74) *Attorney, Agent, or Firm*—Herbert Dubno; Andrew Wilford

(57) ABSTRACT

An electrical connector assembly has a socket body and a plurality of conductors having tips exposed at one side of the socket body. A dielectric plug body is formed with a row of straight and longitudinally extending guides open at a front side of the plug body. The plug body is fittable with the socket body with the guides longitudinally aligned with the socket conductors. A plurality of plug conductors each have a rear portion generally fixed in the plug body, a straight front contact portion longitudinally shiftable in a respective one of the plug-body guides, having a tip exposed at the front side, and longitudinally displaceable in the respective guide between a front position and a rear position, and a connecting portion integrally formed with the front and rear portions, extending at least partially transversely, and elastically deformable to bias the plug-conductor tips into the front positions.

5 Claims, 4 Drawing Sheets

MINIPLUG CONNECTOR ASSEMBLY

FIELD OF THE INVENTION

The present invention relates to an electrical input connector. More particularly this invention concerns a so-called miniplug connector assembly.

BACKGROUND OF THE INVENTION

A miniplug connector assembly is used to connect a small piece of electrical equipment, e.g. a cell phone or pocket computer, to another piece of equipment, e.g. a computer, for charging of the small equipment and/or data exchange between the two devices. For data exchange, it is usually necessary to provide eight to ten electrically independent lines so that, if two more are used for charging purposes, it is common to provide twelve or more conductors.

Normally the connector comprises a socket and a plug. The socket is typically mounted in a stand or cradle or even on the end of a multiconductor cable, where the conductors are exposed at their ends normally on a plane. The plug has a like number of conductors whose tips are aligned on a plane, and each conductor is biased by a small coil spring such that its tip can be depressed perpendicularly from this plane. Thus as the plug, which typically is integral with an end of the device it serves, is fitted to the socket the tips of the conductors in the plug engage the conductors in the socket and are depressed rearward against the force of their springs, ensuring good electrical contact.

The problem with such a connector assembly is that it is relatively complex, so that it is expensive and difficult to manufacture. In addition fitting the biasing springs into the limited space of a miniplug can be quite difficult and runs the risk of shorting adjacent conductors.

OBJECTS OF THE INVENTION

It is therefore an object of the present invention to provide an improved electrical connector assembly.

Another object is the provision of such an improved electrical connector assembly that overcomes the above-given disadvantages, in particular that is of simple and compact construction while being relatively inexpensive to manufacture.

SUMMARY OF THE INVENTION

An electrical connector assembly has according to the invention a dielectric socket body and a plurality of socket conductors having tips aligned in a row and exposed at one side of the socket body. A dielectric plug body is formed with a row of straight, longitudinally extending, and generally parallel guides open at a front side of the plug body. The plug body is fittable with the socket body in a position with the guides longitudinally aligned with the socket conductors. A plurality of plug conductors each have a rear portion generally fixed in the plug body, a straight front contact portion longitudinally shiftable in a respective one of the plug-body guides, having a tip exposed at the front side, and longitudinally displaceable in the respective guide between a front position and a rear position, and a connecting portion integrally formed with the front and rear portions, extending at least partially transversely, and elastically deformable to bias the plug-conductor tips into the front positions.

Thus with this system the contacts themselves form the biasing means. This eliminates the need for separate biasing springs so as to substantially simplify the assembly, so that it can be made very small.

According to the invention the plug-conductor tips project from the front side of the plug body in the front positions. The plug conductors are unitarily formed of a strip of metal and the rear portions are generally parallel to but offset from the respective front portions. The conductors can be stamped from drawn steel sheet coated with copper and then bent permanently to the desired shape.

Each connecting portion in accordance with the invention has a straight central part extending substantially perpendicular to the respective front and rear portions and a pair of elbows connecting the central part with the respective front and rear portions. Each connecting portion can also include a U-shaped bight having a pair of legs extending perpendicular to the respective front and rear portions and connected between the respective front portion and one of the elbows.

According to another embodiment of the invention each connecting portion is formed as a meander having a plurality of parts extending perpendicular to the respective front portion and a plurality of U-bights. Two such meanders can form each connecting portion.

For best spring action, each connecting portion is substantially thinner and more elastically deformable than the respective front and rear portions. In addition the plug-conductor tips have planar faces substantially perpendicular to the respective front portions, and the tips are all substantially coplanar in the front positions.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
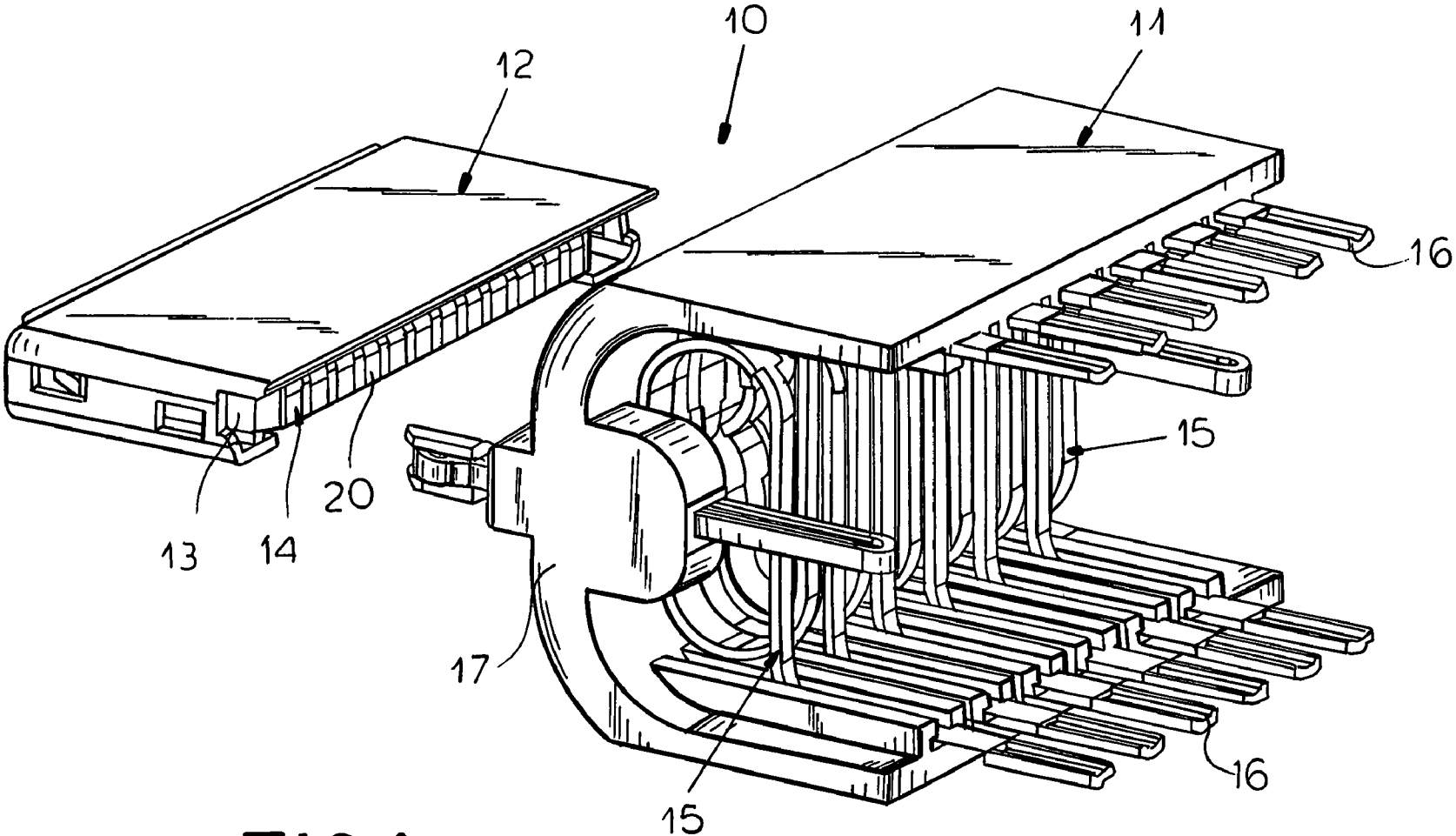
FIG. 1 is a perspective view of the connector assembly according to the invention.
Figure 2:
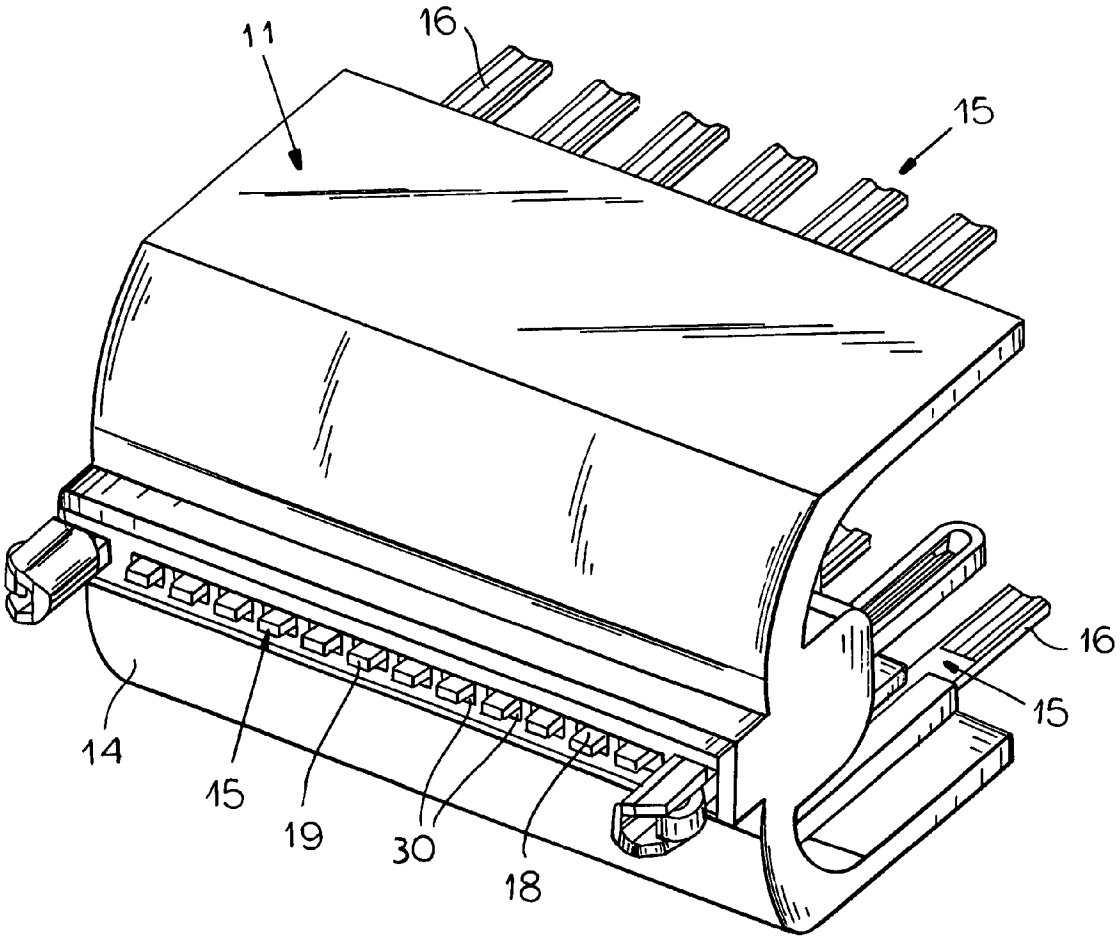
FIG. 2 is a front perspective view of the plug of the FIG. 1 assembly.

As seen in FIGS. 1 and 2, a connector assembly 10 according to the invention basically comprises a plug 11 normally mounted on the end of a piece of equipment such as a cell phone and a socket 12 normally provided on the end of a cable or in a stand or cradle.

The socket 12 basically comprises a dielectric plastic body 13 holding a plurality of conductors 14 having planar ends 20 all arrayed in a common plane. Here there are twelve such conductors 14 and the ends 20 cannot shift relative to the body 13.

Figure 4:
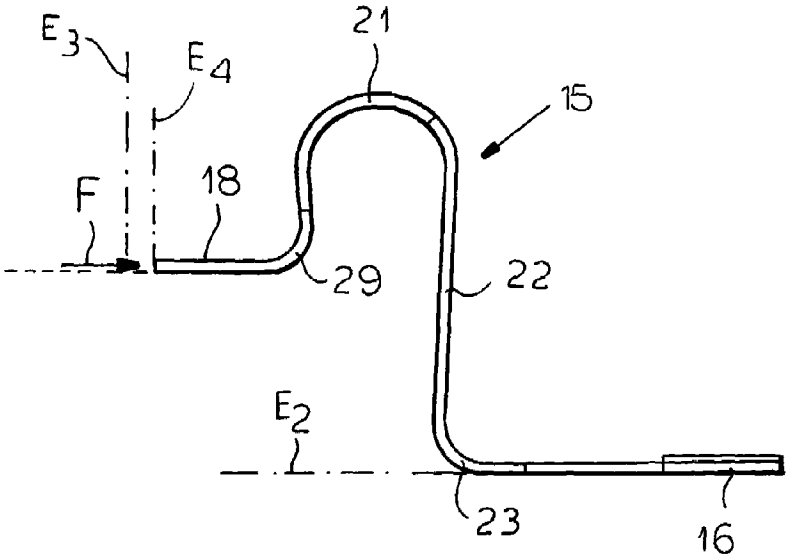
FIGS. 3 and 4 are side views illustrating the plug conductors in accordance with the invention.
Figure 3:
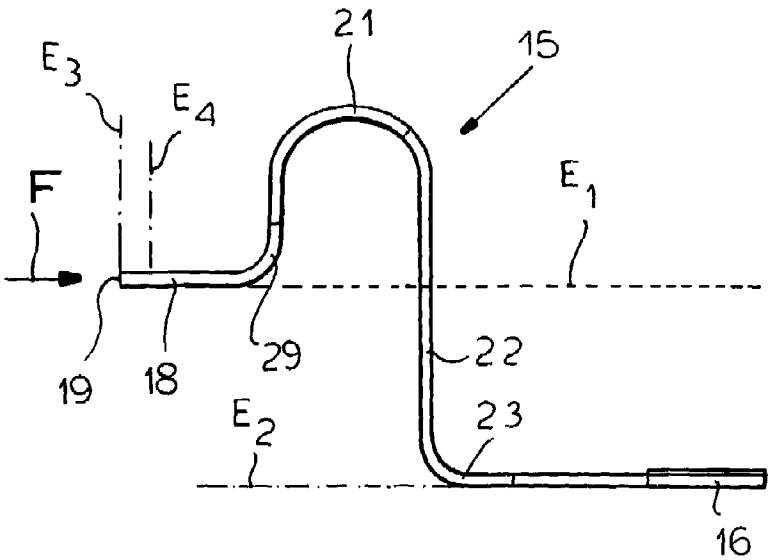

The plug 11 has a dielectric plastic body 17 holding a plurality of conductors 15 having straight front contact portions 18 with flat tips 19 that also all normally lie in a common plane $E_3$ (FIGS. 3 and 4). The body 17 is formed with a straight row of guide passages 30 in which the contact portions 18 are linearly slidable perpendicular to the plane $E_3$ in a guide plane $E_1$. The plug 11 can be inserted into the socket 12 with the tips 19 bearing on the tips 20. The conductors 15 are oriented alternately oppositely and have surface-mount rear portions 16 that can be as wide as the center-to-center spacing of adjacent conductors 15 without contacting one another.

As also shown in FIGS. 3 and 4 each rear end 16 is straight, parallel to the front end portion 18, and adapted for surface-mount or stab-type connection. The rear ends 16 each lie on a plane $E_2$ parallel to but offset from the guide plane $E_1$ of the respective front contact portion 18 and are each fixed in the body 17. A 90° elbow 29 connects the front portion 18 to a front leg of a U-shaped bight portion 21 that in turn has a rear leg connected to a straight connector part 22 extending parallel to the plane $E_3$ across the plane $E_1$ and that is connected by another 90° elbow 23 to the straight rear portion 23. The elbows 29 bear forwardly on the body 17 at the rear ends of the guides 30 to prestress the contact portions 18 into a front position projecting forward from the guides 30. The front and rear portions 18 and 16 are wider than the S- or Z-shaped connecting portion formed by the elbows 23 and 29, the U-bight 21, and the straight central part 22.

When the plug 11 is inserted into the socket 12 and the tips 19 of the conductors 15 engage the tips 20 of the conductors 14, a force F will be exerted on the tips 19 to displace them backward from the FIG. 3 position where they lie on the plane $E_3$ to the FIG. 4 position where they lie on the parallel plane $E_4$. This rearward movement of the front portions 18 in the guides 30 is permitted by elastic deformation of the conductors 15 in the regions 21, 22, 23, and 29. Thus the tips 19 will be pressed elastically against the tips 20 for good electrical contact, but no extra parts are required to supply this spring biasing. In fact under normal conditions the tips 19 are prestressed forward, that is into the FIG. 3 position lying on the plane $E_3$.

Figure 6:
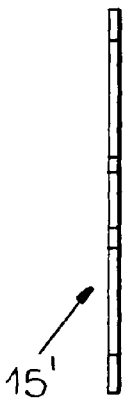
FIG. 6 is an end view of the structure of FIG. 5.
Figure 5:
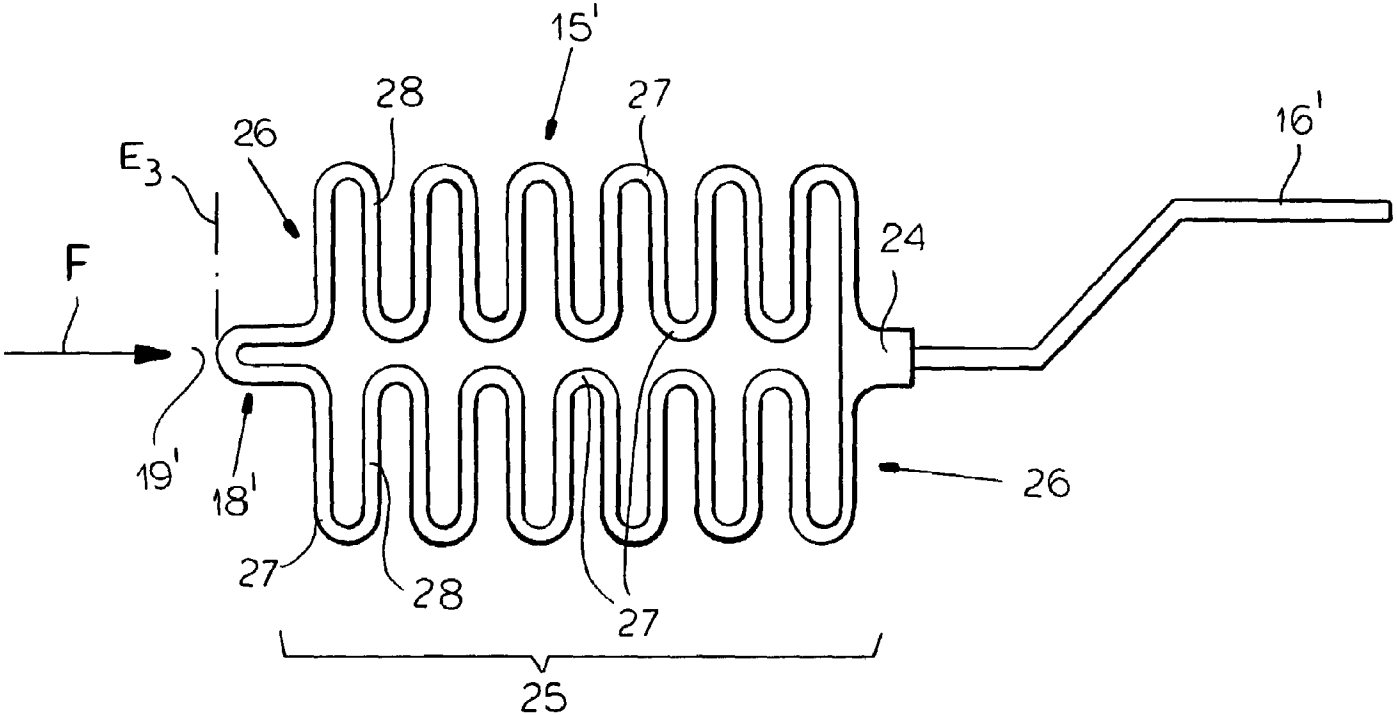
FIG. 5 is a view like FIGS. 3 and 4 of an alternative plug conductor.

In FIGS. 5 and 6 a conductor 15' is shown that can replace any of the conductors 15 of FIGS. 1 to 4. It has a central region 25 connecting the front contact portion 18' with the tip 19' and via a socket 24 with the rear connector portion 16'. The region 25 is formed by a pair of meanders 26 each comprised of a plurality of parallel straight sections 28 extending parallel to the plane $E_3$ and connected by U-shaped bights 27. Thus elastic deformation of the meanders 26 ensures perfect movement of the tip 19' perpendicular to the plane $E_3$.

We claim:

1. An electrical connector assembly comprising:

a dielectric socket body;

a plurality of socket conductors having tips aligned in a row and exposed at one side of the socket body;

a dielectric plug body formed with a row of straight, longitudinally extending, and generally parallel guides open at a front side of the plug body and defining a guide plane, the plug body being fittable with the socket body in a position with the guides longitudinally aligned with the socket conductors; and a plurality of plug conductors each having a rear portion generally fixed in the plug body and extending rearwardly out of a rear side of the plug body on a plane offset from but parallel to the guide plane, a straight front contact portion longitudinally shiftable on the guide plane in a respective one of the plug-body guides, having a tip exposed at the front side, and longitudinally displaceable in the respective guide between a front position with the tip projecting forward from the front side and a rear position, and a straight central part extending substantially perpendicular to the planes, a U-shaped bight having front and rear legs extending substantially perpendicular to the planes the rear leg being connected to the straight central part, a front elbow connecting the front bight leg to the front portion, a rear elbow connecting the straight central part to the rear portion, the front and rear portions, central part, bight, and elbows of each plug conductor being integrally formed with one another, the parts, bights, and elbows being elastically deformable to bias the plug-conductor tips into the front positions.

2. The electrical connector assembly defined in claim 1 wherein the plug conductors are unitarily formed of a strip of metal.

3. The electrical connector assembly defined in claim 1 wherein parts, bights, and elbows are substantially thinner and more elastically deformable than the respective front and rear portions.

4. The electrical connector assembly defined in claim 1 wherein the plug-conductor tips have planar faces substantially perpendicular to the respective front portions.

5. The electrical connector assembly defined in claim 1 wherein the tips are all substantially coplanar in the front positions.

* * * * *